US010734135B2

(12) United States Patent
Hori

(10) Patent No.: US 10,734,135 B2
(45) Date of Patent: Aug. 4, 2020

(54) SMALL-DIAMETER INSULATED WIRE

(71) Applicant: SUMITOMO ELECTRIC INDUSTRIES, LTD., Osaka-shi, Osaka (JP)

(72) Inventor: Kenji Hori, Kanuma (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/633,876

(22) PCT Filed: Apr. 27, 2018

(86) PCT No.: PCT/JP2018/017269
§ 371 (c)(1),
(2) Date: Jan. 24, 2020

(87) PCT Pub. No.: WO2019/021563
PCT Pub. Date: Jan. 31, 2019

(65) Prior Publication Data

US 2020/0176148 A1 Jun. 4, 2020

(30) Foreign Application Priority Data

Jul. 25, 2017 (JP) ..... 2017-143577

(51) Int. Cl.
*H01B 7/04* (2006.01)
*H01B 3/44* (2006.01)
*H01B 7/02* (2006.01)

(52) U.S. Cl.
CPC ..... *H01B 7/04* (2013.01); *H01B 3/445* (2013.01); *H01B 7/02* (2013.01)

(58) Field of Classification Search
CPC ..... H01B 7/04; H01B 3/445; H01B 7/02
USPC ..... 174/110 R
See application file for complete search history.

(56) References Cited

U.S. PATENT DOCUMENTS

2010/0212933 A1* 8/2010 Hayashishita ..... H01B 11/1895 174/113 C
2014/0090868 A1* 4/2014 Ohgushi ..... H01B 13/148 174/110 R
2016/0284437 A1* 9/2016 Inoue ..... H01B 1/026
2016/0289857 A1* 10/2016 Kondo ..... H01B 1/04
2017/0309369 A1* 10/2017 Oshima ..... H01B 1/026

FOREIGN PATENT DOCUMENTS

JP H01-239714 A 9/1989
JP 2012-146431 A 8/2012
JP 2012-174337 A 9/2012
JP 2017-016847 A 1/2017

* cited by examiner

*Primary Examiner* — Sherman Ng
(74) *Attorney, Agent, or Firm* — Oliff PLC

(57) ABSTRACT

A small-diameter insulated wire has a small diameter and high bending resistance. In a small-diameter insulated wire having a conductor and an insulating layer covering the conductor, a cross-sectional area of the conductor is 0.08 mm2 or more and 0.4 mm2 or less, the conductor is a copper alloy having a breaking strength of 815 MPa or more, a breaking strength of the insulating layer is 36.5 MPa or more, a thickness of the insulating layer is 0.1 mm or more and 0.2 mm or less, and a conductor pullout force for drawing the conductor from the small-diameter insulated wire is 9 N/30 mm or less.

4 Claims, 1 Drawing Sheet

SMALL-DIAMETER INSULATED WIRE

TECHNICAL FIELD

The present disclosure relates to a small-diameter insulated wire.

This application claims priority based on Japanese Patent Application No. 2017-143577 filed on Jul. 25, 2017, the contents of which are incorporated herein by reference in its entirety.

BACKGROUND ART

PTLs 1 and 2 disclose a small-diameter insulated wire having a conductor and an insulating layer covering the conductor.

CITATION LIST

Patent Literature

[PTL 1] JP-A-2012-174337
[PTL 2] JP-A-2017-16847

SUMMARY OF INVENTION

A small-diameter insulated wire according to an aspect of the present disclosure is a small-diameter insulated wire having a conductor and an insulating layer covering the conductor, in which a cross-sectional area of the conductor is 0.08 $mm^2$ or more and 0.4 $mm^2$ or less, the conductor is a copper alloy having a breaking strength of 815 MPa or more, a breaking strength of the insulating layer is 36.5 MPa or more, a thickness of the insulating layer is 0.1 mm or more and 0.2 mm or less, and a conductor pullout force for drawing the conductor from the small-diameter insulated wire is 9 N/30 mm or less.

MODES FOR CARRYING OUT INVENTION

Technical Problem

In order to obtain even higher bending resistance in a small-diameter insulated wire, it is necessary to increase the diameter of the wire.

Therefore, an object of the present disclosure is to provide a small-diameter insulated wire that has a small diameter and high bending resistance.

Advantageous Effects of Invention

According to the present disclosure, it is possible to provide a small-diameter insulated wire that has a small diameter and high bending resistance.

DESCRIPTION OF EMBODIMENTS

First, embodiments of the present disclosure will be listed and described.

A small-diameter insulated wire according to an embodiment of the present disclosure is (1) a small-diameter insulated wire having a conductor and an insulating layer covering the conductor, in which a cross-sectional area of the conductor is 0.08 $mm^2$ or more and 0.4 $mm^2$ or less, the conductor is a copper alloy having a breaking strength of 815 MPa or more, a breaking strength of the insulating layer is 36.5 MPa or more, a thickness of the insulating layer is 0.1 mm or more and 0.2 mm or less, and a conductor pullout force for drawing the conductor from the small-diameter insulated wire is 9 N/30 mm or less.

According to the above configuration, it is possible to provide a small-diameter insulated wire that has a small diameter and high bending resistance.

(2) The insulating layer may be fluororesin.

According to the above configuration, by using the fluororesin for the insulating layer, it is possible to provide a small-diameter insulated wire having a small diameter and higher bending resistance.

(3) The resin constituting the insulating layer may be cross-linked.

According to the above structure, the resin that forms the insulating layer is cross-linked, and it is possible to provide a small-diameter insulated wire having a small diameter and a higher bending resistance.

DETAILED DESCRIPTION OF EMBODIMENTS

Specific examples of a small-diameter insulated wire according to embodiments of the present disclosure will be described below with reference to the drawings.

In addition, the disclosure is not limited to these embodiments, but is intended to be indicated by the claims, and includes all modifications within the scope and meaning equivalent to the claims.

Figure 1:
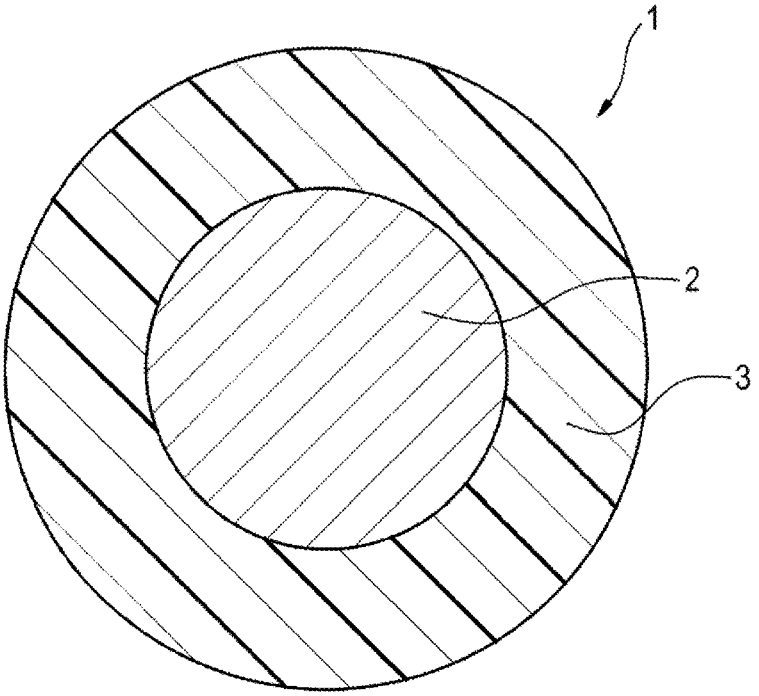
FIG. 1 is a cross-sectional view showing a small-diameter insulated wire according to an embodiment.

FIG. 1 shows an example of a small-diameter insulated wire. The small-diameter insulated wire 1 is suitable for use in wiring of any movable part including a robot, for example.

As shown in FIG. 1, the small-diameter insulated wire 1 includes a conductor 2 and an insulating layer 3 provided outside the conductor 2.

The conductor 2 is configured as a stranded wire conductor formed by twisting a plurality of wires. A copper alloy wire having a high breaking strength is used as the wire for forming the conductor 2. For example, it is preferable to use a copper-tin alloy wire (containing 0.1 to 1.0% of tin) for the wire of the conductor 2. A copper alloy wire plated with tin or the like may be used.

The diameter of the wire is 0.05 mm to 0.16 mm. The cross-sectional area of the conductor 2 formed as the stranded wire is 0.08 $mm^2$ or more and 0.4 $mm^2$ or less, and the diameter thereof is about 0.32 mm to 0.72 mm. In addition, the breaking strength of the conductor 2 is 815 MPa or more.

The insulating layer 3 is covered on an outer periphery of the conductor 2 by drawdown extrusion on the outer periphery of the conductor 2, for example. For the resin material that forms the insulating layer 3, fluororesin is used. For the fluororesin, ETFE, which is a copolymer of tetrafluoroethylene and ethylene, is preferable, for example. After being coated around the conductor 2, the fluororesin that forms the insulating layer 3 may be subjected to cross-linking treatment by, for example, irradiation with ionizing radiation (electron beam, gamma ray, and the like), in order to improve wear resistance, heat resistance, and oil resistance.

The thickness of the insulating layer 3 is 0.1 mm or more and 0.2 mm or less. The breaking strength of the insulating layer 3 is 36.5 MPa or more.

An outer diameter of the small-diameter insulated wire 1 configured in this manner may be in a range of 0.6 mm to 1.2 mm. Specifically, for example, the small-diameter insulated wire 1 formed by coating the conductor 2 having a cross-sectional area of 0.18 $mm^2$ (0.48 mm in diameter) with the insulating layer 3 having a thickness of 0.2 mm has an outer diameter of 0.88 mm. In addition, the conductor pullout force for drawing the conductor 2 from the small-diameter insulated wire 1 is 9 N/30 mm or less. The conductor pullout force is preferably 1 N/30 mm or more such that the conductor and the insulating layer do not shift when the conductor is extracted by removing the insulating layer from the electronic wire.

The small-diameter insulated wires of Examples 1 to 3 and Comparative Examples 1 and 2 described below were prepared, and bending tests were performed with respect to each of the small-diameter insulated wires.

Example 1

In Example 1, a conductor 2 having a cross-sectional area of 0.14 $mm^2$ (AWG26) and a breaking strength of 815 MPa was formed by twisting seven copper alloy wires having an outer diameter of 0.16 mm. The insulating layer 3 made of ETFE and having a thickness of 0.2 mm and a breaking strength of 36.5 MPa was formed on an outer periphery of the conductor 2 by drawdown extrusion molding. Then, this insulating layer 3 was subjected to cross-linking treatment to prepare a small-diameter insulated wire 1 having an outer diameter of 0.88 mm. The conductor pullout force for the small-diameter insulated wire 1 of Example 1 prepared as described above was 9 N/30 mm.

Example 2

In Example 2, the same conductor 2 as in Example 1 was formed, and an insulating layer 3 made of ETFE was formed on the outer periphery of the conductor 2 by drawdown extrusion molding to prepare a small-diameter insulated wire 1. It is to be noted that the thickness of the insulating layer 3, the breaking strength, and the outer diameter of the small-diameter insulated wire 1 are the same as in Example 1. The conductor pullout force for the small-diameter insulated wire 1 according to Example 2 prepared as described above was 9 N/30 mm.

Comparative Example 1

In Comparative Example 1, a conductor having a cross-sectional area of 0.14 $mm^2$ (AWG26) and a breaking strength of 250 MPa was formed by twisting seven annealed copper wires having an outer diameter of 0.16 mm. The insulating layer made of fluoro-rubber and having a thickness of 0.2 mm and a breaking strength of 10.7 MPa was formed on an outer periphery of the conductor by solid extrusion molding. Then, this insulating layer was subjected to cross-linking treatment to prepare a small-diameter insulated wire having an outer diameter of 0.88 mm. The conductor pullout force for the small-diameter insulated wire according to Comparative Example 1 prepared as described above was 12 N/30 mm.

Example 3

In Example 3, a conductor 2 having a cross-sectional area of 0.08 $mm^2$ (AWG28) and a breaking strength of 815 MPa was formed by twisting 44 copper alloy wires having an outer diameter of 0.05 mm. The insulating layer 3 made of ETFE and having a thickness of 0.1 mm and a breaking strength of 36.5 MPa was formed on an outer periphery of the conductor 2 by drawdown extrusion molding to prepare a small-diameter insulated wire 1 having an outer diameter of 0.6 mm. The conductor pullout force for the small-diameter insulated wire 1 according to Example 3 prepared as described above was 8 N/30 mm.

Comparative Example 2

In Comparative Example 2, a conductor having a cross-sectional area of 0.08 $mm^2$ (AWG28) and a breaking strength of 250 MPa was formed by twisting seven annealed copper wire having an outer diameter of 0.127 mm. The insulating layer made of polyethylene and having a thickness of 0.1 mm and a breaking strength of less than 36.5 MPa was formed on an outer periphery of the conductor by solid extrusion molding. Then, this insulating layer was subjected to cross-linking treatment to prepare a small-diameter insulated wire having an outer diameter of 0.6 mm. The conductor pullout force for the small-diameter insulated wire according to Comparative Example 2 prepared as described above was 12 N/30 mm.

(Bending Test)

Figure 2:
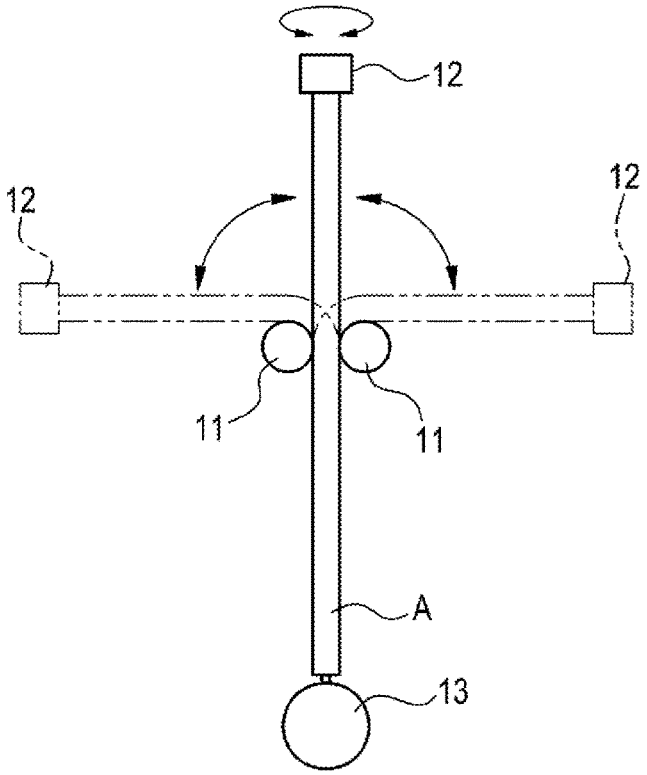
FIG. 2 is a schematic diagram of a bending test.

The bending resistance of a cable was evaluated based on the bending test specified in ISO 14572: 2011 (E) 5.9. In this bending test, as shown in FIG. 2, a small-diameter insulated wire A was passed through between a pair of mandrels 11 such that the small-diameter insulated wire A was vertically suspended, and an upper end of the small-diameter insulated wire A is held by a chuck 12, and a weight 13 was attached to a lower end. By swinging the chuck 12 in a pendulum shape along a circumference centered between the mandrels 11, the small-diameter insulated wire A was repeatedly bent from −90° to +90° toward the respective mandrels 11 sides. While bending at a rate of 60 times/minute, the number of bends until the small-diameter insulated wire A was broken was measured, in which bending from −90° to +90° was counted as one bend. In Examples 1 and 2, and Comparative Example 1, the diameter of the mandrel 11 was 12.5 mm, and the weight of the weight 13 was 500 g. In Example 3 and Comparative Example 2, the diameter of the mandrel 11 was 4 mm, and the load of the weight 13 was 100 g.

(Test Results)

In Example 1, the average number of bends until breakage was 12212, and in Example 2, the average number of bends until breakage was 10929. Meanwhile, in Comparative Example 1, the average number of bends until breakage was less than 10000. As a result, it was confirmed that Examples 1 and 2 had better resistance to bending than Comparative Example 1. Moreover, in Example 3, the average number of bends until breakage was 49803. Meanwhile, in Comparative Example 2, the average number of bends until breakage was 461. As a result, it was confirmed that Example 3 had better resistance to bending than Comparative Example 3. Moreover, the number of bends in Example 1 exceeded the number of bends in Example 2, and it was confirmed that the bending resistance was improved by subjecting the insulating layer 3 to cross-linking treatment.

According to the small-diameter insulated wire 1 as described above, the conductor 2 formed of a copper alloy having a breaking strength of 815 MPa or more is covered with the insulating layer 3 formed of a cross-linked fluororesin having a breaking strength of 36.5 MPa or more. For this reason, even when the cross-sectional area of the conductor 2 is 0.08 $mm^2$ or more and 0.4 $mm^2$ or less and the thickness of the insulating layer 3 is thinned to 0.1 mm or more and 0.2 mm or less, an insulated wire having high bending resistance can be obtained. Further, the insulating layer 3 is subjected to cross-linking treatment so that the bending resistance can be improved, and the diameter of the electronic wire can be further thinned. Moreover, the conductor pullout force for the small-diameter insulated wire 1 can be 9 N/30 mm or less by forming the insulating layer 3 by drawdown extrusion molding.

As described above, while the invention has been described in detail and with reference to specific embodiments thereof, it will be apparent to those skilled in the art that various changes and modifications can be made without departing from the spirit and scope of the invention. Further, the number, the position, the shape, and the like of the above-described constituent members are not limited to the above embodiments, and can be changed to a suitable number, a position, a shape, and the like for implementing the present invention.

REFERENCE SIGNS LIST

1: small-diameter insulated wire
2: conductor
3: insulating layer
11: mandrel
12: chuck
13: weight

The invention claimed is:

1. A small-diameter insulated wire comprising:
a conductor; and
an insulating layer covering the conductor, wherein
a cross-sectional area of the conductor is 0.08 $mm^2$ or more and 0.4 $mm^2$ or less,
the conductor is a copper alloy having a breaking strength of 815 MPa or more,
a breaking strength of the insulating layer is 36.5 MPa or more,
a thickness of the insulating layer is 0.1 mm or more and 0.2 mm or less, and
a conductor pullout force for drawing the conductor from the small-diameter insulated wire is 9 N/30 mm or less.

2. The small-diameter insulated wire according to claim 1, wherein the insulating layer is fluororesin.

3. The small-diameter insulated wire of claim 1, wherein the resin that forms the insulating layer is cross-linked.

4. The small-diameter insulated wire of claim 2, wherein the resin that forms the insulating layer is cross-linked.

* * * * *